US007014554B1

(12) United States Patent
Fletcher et al.

(10) Patent No.: US 7,014,554 B1
(45) Date of Patent: Mar. 21, 2006

(54) ADAPTABLE COIN MECHANISM

(75) Inventors: Paul R. Fletcher, Camberly (GB); Craig A. Lewis, Berwln, PA (US); Gregory J. Billington, Reading (GB)

(73) Assignee: Mars Incorporated, McLean, VA (US)

( * ) Notice: Subject to any disclaimer, the term of this patent is extended or adjusted under 35 U.S.C. 154(b) by 431 days.

(21) Appl. No.: 09/518,627

(22) Filed: Mar. 3, 2000

Related U.S. Application Data

(63) Continuation of application No. 09/172,981, filed on Oct. 14, 1998, now abandoned, which is a continuation of application No. 08/710,787, filed on Sep. 20, 1996, now abandoned.

(51) Int. Cl.
*G07D 1/02* (2006.01)

(52) U.S. Cl. ..... 453/20; 194/217

(58) Field of Classification Search ..... 194/215–217, 194/218; 453/17, 20
See application file for complete search history.

(56) References Cited

U.S. PATENT DOCUMENTS

| | | | |
|---|---|---|---|
| 3,814,115 A | 6/1974 | Van Acker | |
| 3,841,456 A | 10/1974 | Levasseur | |
| 3,963,035 A | 6/1976 | Levasseur | |
| 4,462,512 A | 7/1984 | Schuller | |
| 4,491,140 A | 1/1985 | Eglise et al. | |
| 4,499,982 A | 2/1985 | Sugimoto et al. | |
| 4,587,984 A | 5/1986 | Levasseur et al. | |
| 4,625,852 A | 12/1986 | Hoormann | |
| 4,646,904 A | 3/1987 | Hoormann | |
| 4,706,202 A | 11/1987 | Kobayashi et al. | |
| 4,739,869 A | 4/1988 | Hoormann | |
| 4,763,769 A | 8/1988 | Levasseur | |
| 5,036,966 A | 8/1991 | Kaspar et al. | |
| 5,184,708 A | 2/1993 | Levasseur | |
| 5,293,979 A | 3/1994 | Levasseur | |
| 5,310,035 A | 5/1994 | Dobransky, Jr. et al. | |
| 5,356,332 A | 10/1994 | Thompson et al. | 453/3 |
| 5,377,809 A | 1/1995 | Ibarrola | 194/317 |
| 5,400,891 A | 3/1995 | Winstanley | 194/350 |

(Continued)

FOREIGN PATENT DOCUMENTS

| | | |
|---|---|---|
| DE | 41 01 949 | 7/1992 |

(Continued)

OTHER PUBLICATIONS

Mars Electronics International, Inc., "MS 3922 Multicard Revaluation Terminal: Installation Guide," Rev. pp. 1-13 (prior to Sep. 20, 1995).

(Continued)

*Primary Examiner*—Richard Chilcot
(74) *Attorney, Agent, or Firm*—Fish & Richardson P.C.

(57) ABSTRACT

A coin mechanism has one or more coin tubes for storing, respectively, coins of one or more denominations, a dispenser for controlling the dispensing of coins from the coin tubes, and a coin mechanism controller suitable for connection to a controller in an automatic transaction system so as to receive change dispense signals from the automatic transaction system controller indicating the form of dispensing change to a customer. The coin mechanism controller, when connected to the automatic transaction system controller, serves as an interface between the automatic transaction system controller and the dispenser, and is programmed to re-determine the form of paying out the change, for example, by taking into account the distribution and denominations of the coins in the coin tubes. The arrangement of coin tubes in a coin tube cassette for use with the coin mechanism can be identified by entering a code on a keypad associated with the coin mechanism.

12 Claims, 7 Drawing Sheets

U.S. PATENT DOCUMENTS

| | | | | |
|---|---|---|---|---|
| 5,458,536 | A | 10/1995 | Kargathra et al. | 453/17 |
| 5,542,519 | A | 8/1996 | Weston et al. | 194/217 |
| 5,595,277 | A | 1/1997 | Hoormann et al. | 194/217 |
| 5,733,186 | A | 3/1998 | Leibu | 194/215 |

FOREIGN PATENT DOCUMENTS

| | | | |
|---|---|---|---|
| GB | 2098776 | 11/1982 | 194/218 |
| GB | 2203137 | 10/1988 | |
| GB | 2269258 | 2/1994 | 453/20 |
| WO | WO 95/14290 | 5/1995 | |

OTHER PUBLICATIONS

Mars Electronics International, Inc., "MS2200 Multicard Debit Card Reader: Installation Guide," pp. 1-9 (prior to Sep. 20, 1995).

Mars Electronics International, Inc., "MS2200 Debit Card Reader: Operations and Maintenance Guide," Rev pp. 1-10 (prior to Sep. 20, 1995).

Mars Electronics International, Inc., schematics of U.S. Multi Card Control Board, Drawing No. 07-08-291, 2 sheets (prior to Sep. 20, 1995).

ADAPTABLE COIN MECHANISM

RELATED APPLICATIONS

The present application is a continuation of U.S. Ser. No. 09/172,981, filed Oct. 14, 1998 now abandoned, which is a continuation of U.S. Ser. No. 08/710,787, filed Sep. 20, 1996 now abandoned, incorporated herein by reference in its entirety

BACKGROUND OF THE INVENTION

The invention relates generally to an adaptable coin mechanism for use, for example, in gaming and vending machines.

Existing vending machines typically include one or more slots through which a customer can insert coins or bills to initiate a vend operation for the purpose of purchasing a product from the machine. Such machines also include coin mechanisms and bill acceptors for identifying inserted coins and bills, and for providing change to the customer. Typically, a central controller controls the overall performance of the machine, such as keeping track of the total credit available to the customer, actuating motors or other mechanisms to dispense a product selected by the customer, and providing signals to the coin mechanism indicating the amount of change, if any, that is to be dispensed.

The central controller of the vending machine is typically programmed to recognize and generate signals corresponding to a predetermined set of coin denominations, such as U.S. nickels, dimes and quarters. However, an operator or owner of the vending machine may desire a vending machine with greater flexibility to allow, for example, the vending machine to provide change using a different combination or set of coin denominations. For example, with the introduction of U.S. one-dollar coins, vending machine operators and owners may wish to dispense a single one-dollar coin as change rather than an equivalent amount in multiple lower denomination coins. In general, vending machine operators and owners may wish to accept currency and dispense change using sets of coin denominations that are different from the set of coin denominations which the central controller is programmed to handle.

SUMMARY OF THE INVENTION

In general, in one aspect, the invention features a coin mechanism having one or more coin tubes for storing, respectively, coins of one or more denominations, a dispenser for controlling the dispensing of coins from the coin tubes, and a coin mechanism controller suitable for connection to a controller in an automatic transaction system so as to receive change dispense signals from the automatic transaction system controller indicating the form of dispensing change to a customer. The coin mechanism controller, when connected to the automatic transaction system controller, serves as an interface between the automatic transaction system controller and the dispenser, and is programmed to re-determine the form of paying out the change.

Various implementations of the invention include one or more of the following features. The coin mechanism controller can be programmed, for example, to re-determine the coin denominations in which the change is to be dispensed by taking into account the distribution and denominations of coins in the coin tubes. The coin mechanism controller can also be programmed to re-determine the number and denomination of coins in which the change is to be dispensed when the set of available coin denominations in the coin tubes differs from the set of coin denominations which the automatic transaction system controller is programmed to handle. In addition, the coin mechanism controller can be programmed to re-determine the number and denomination of coins in which the change is to be dispensed when the set of available coin denominations in the coin tubes differs from the coin denominations corresponding to the change dispense signals received from the automatic transaction system.

In certain implementations, the coin mechanism is suitable for connection to an automatic transaction system controller capable of providing signals to indicate the number and denomination of coins in which change is to be dispensed using three different coin denominations, and the coin mechanism includes four coin tubes for storing, respectively, coins of four different denominations. The three coin denominations can be, for example, U.S. nickels, dimes and quarters, whereas the four coin denominations can be U.S. nickels, dimes, quarters and one-dollars.

In yet other implementations of the invention, the coin mechanism controller is programmed to re-determine the number and denomination of coins in which the change is to be dispensed using as many available higher denomination coins as possible. In one technique, the coin mechanism controller is programmed to monitor the change dispense signals from the automatic transaction controller, to accumulate values corresponding to the monitored signals, and to control the dispenser to dispense change from the coin tubes only after no further change dispense signal is received for at least a specified duration following the previous change dispense signal. In a second technique, the coin mechanism controller is programmed to monitor the change dispense signals from the automatic transaction controller, to accumulate values corresponding to the monitored signals, and to control the dispenser to dispense change from the coin tubes once the accumulated total value is at least equal to or higher than the value of the highest available coin denomination in the coin tubes. According to yet a third technique, the coin mechanism controller is programmed to monitor the change dispense signals from the automatic transaction controller, to accumulate values corresponding to a predetermined number of the monitored signals, and to control the dispenser to dispense change from the coin tubes immediately following receipt of the predetermined number of monitored signals.

In another aspect, the invention features an automatic transaction system including a coin insert slot, a coin return, and a system controller for determining the amount of change due a customer as well as the number and denominations of coins in which the change is to be dispensed. The system controller uses a particular set of coin denominations for determining the form in which change is to be dispensed. The automatic transaction system also includes a coin mechanism connected to the coin insert slot and the coin return. The coin mechanism has sensors for generating signals indicative of the characteristics of an inserted coin and a coin mechanism controller programmed to determine whether the inserted coin is acceptable based on the signals generated by the sensors. The coin mechanism also has one or more coin tubes for storing, respectively, acceptable coins of one or more denominations, and a dispenser for controlling the dispensing of coins from the coin tubes in response to dispense signals from the coin mechanism controller. In addition, communication lines connect the coin mechanism controller and the system controller, whereby the coin mechanism receives change dispense signals from the system controller indicating the number and denominations of coins in which change is to be dispensed. The coin mechanism controller is programmed to re-determine the number and denominations of coins in which the change is to be dispensed by taking into account the distribution and denominations of coins in the coin tubes.

In yet another aspect, the invention features a coin mechanism suitable for receiving a removable, replaceable cassette having one or more coin tubes for storing, respectively, coins of one or more denominations. The coin mechanism includes a coin mechanism controller suitable for connection to a controller in an automatic transaction system so as to receive change dispense signals from the automatic transaction system controller indicating the number and denominations of coins in which change is to be dispensed to a customer, wherein the coin mechanism controller, when connected to the automatic transaction system controller, serves as an interface between the automatic transaction system controller and a coin dispenser, and wherein the coin mechanism controller is programmed to re-determine the coin denominations in which the change is to be dispensed by taking into account the distribution and denominations of coins in the coin tubes. The coin mechanism also includes a dispenser for controlling, in response to dispense signals from the coin mechanism controller, the dispensing of coins from the coin tubes in the cassette, and a keypad for entering a code to identify to the coin mechanism controller the arrangement and corresponding denominations of coin tubes in the cassette.

In a further aspect, the invention features a method of providing change from an automatic transaction system including generating change dispense signals corresponding to the number and denomination of coins in which the change is to be dispensed and receiving the change dispense signals in a coin mechanism controller. The method also includes re-determining the number and denomination of coins in which the change is to be dispensed by taking into account the distribution and denominations of coins in coin tubes associated with the coin mechanism and generating new change dispense signals based on the step of re-determining to control the operation of a coin dispenser. Coins are dispensed from the coin tubes according to the number and denominations determined by the coin mechanism controller.

In an additional aspect, the invention features a method of identifying a coin tube arrangement during replacement of a coin tube cassette in a coin mechanism. The method includes entering a code corresponding to the coin tube arrangement using a keypad connected to the coin mechanism and recognizing the code. The coin mechanism is operated with the cassette inserted in the coin mechanism. The code can include letters, numbers, or a combination or sequence of letters and numbers. Coins accepted by the coin mechanism can be stored in the appropriate coin tubes of the identified cassette, and coins stored in the coin tubes of the identified cassette can be used to provide the proper change to a customer.

In yet further aspects, the invention features a method of accumulating currency in an automatic transaction system including receiving an inserted coin in a coin mechanism and routing the coin to one of a plurality of coin storage tubes. A signal is generated indicating that the coin was routed to a cash box. In response to the signal indicating that the coin was routed to the cash box, a bill validator can be controlled to accept bills of a specified denomination. The invention also features a method of accumulating currency in an automatic transaction system including receiving an inserted coin in a coin mechanism and routing the coin to a cash box. A signal indicating that the coin was routed to one of a plurality of coin storage tubes is generated. In response to the signal indicating that the coin was routed to one of the coin storage tubes, a bill validator can be controlled so as to reject bills of a specified denomination.

In various implementations, the invention provides one or more of the following advantages. Since the coin mechanism controller serves as an interface between the automatic transaction system controller and other components in the coin mechanism, the coin mechanism can be used to update existing automatic transaction systems without replacing the system controller. For example, an existing automatic transaction system can be upgraded to accommodate new or different combinations of coin sets by replacing an existing coin mechanism with the coin mechanism of the invention. In particular, an existing automatic transaction system can be upgraded relatively easily to accept payment and dispense change in the form of new or different combinations of coin denominations. For example, by using the coin mechanism of the invention, an automatic transaction system can be updated to dispense a one-dollar coin even though the existing system controller generates signals indicating that four quarters should be dispensed. Furthermore, removable and replaceable cassettes with different arrangements of coin tubes can be used with a single coin mechanism. The use of a keypad allows service personnel to enter a code which is recognized by the coin mechanism controller and provides a convenient means for identifying the coin tube arrangement in the cassette to the coin mechanism controller. The coin mechanism of the invention can, therefore, provide enhanced flexibility and adaptability to existing systems with relative ease and at relatively low cost.

Additional features and advantages of the invention will be readily apparent from the following detailed description, accompanying drawings and claims.

DESCRIPTION OF THE PREFERRED EMBODIMENTS

Figure 1:
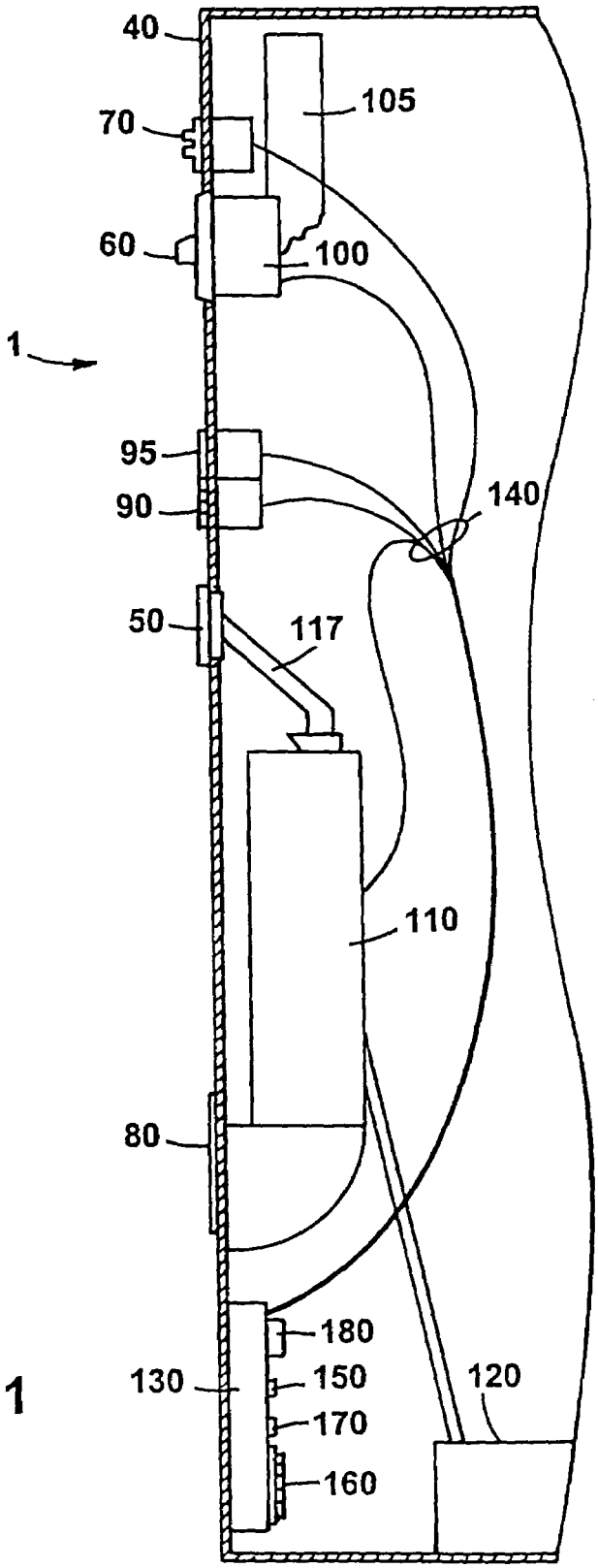
FIG. 1 is a partial cut-away side view of an automatic transaction system in which the invention can be used.

FIG. 1 shows a partial cut-away side view of an automatic transaction system such as a vending machine 1. A control panel 40 of the automatic transaction system 1 includes a coin slot 50 and a banknote or bill insert slot 60 which accept currency to initiate a vend operation. In some implementations, the control panel 40 further contains a card acceptor 70 to enable customers to initiate transactions with credit or debit cards.

The control panel 40 also includes a coin return 80 and an item selector such as a keypad 90. A display 95 on the control panel 40 can provide instructions and information to the customer.

Currency acceptors, such as a bill validator 100 and a coin mechanism 110 are attached to the rear of the control panel 40 adjacent the bill insert and coin slots 60 and 50, respectively. The coin mechanism 110 is connected to the coin return 80 and to a coin passageway 117 leading to the coin slot 50. The coin mechanism 110 is also connected to a cash box 120. The bill validator 100 is connected to a bill stacker 105.

The bill validator 100, coin mechanism 110, card acceptor 70, keypad 90 and display 95 are connected to a vend controller 130 by communication lines 140. The controller 130 is further connected to data entry devices, such as DIP switches 150, a keypad 160, an input/output port 170, as well as a display 180 to facilitate servicing of the vending machine 1. The components disposed behind the control panel 40 are not accessible to customers of the vending machine 1 and can only be accessed by service personnel.

Figure 2:
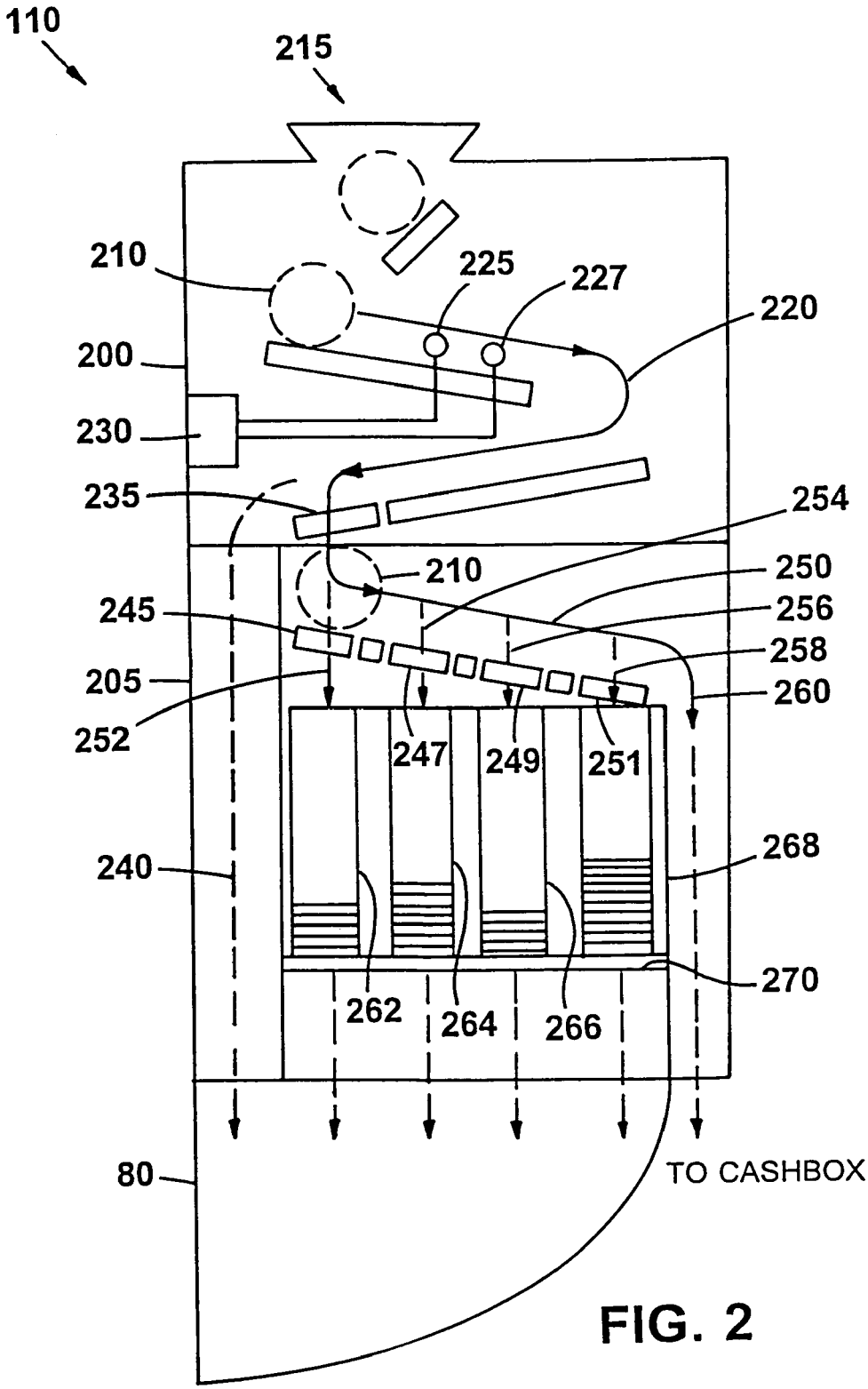
FIG. 2 is a cut-away view of a coin mechanism according to the present invention.

FIG. 2 shows a removable coin mechanism which can be used as the coin mechanism 110 in FIG. 1. The coin mechanism 110 includes a coin validator 200 and a coin separator 205. The coin validator 200 receives inserted coins 210 through an opening 215 which is connected to the coin passageway 117 of FIG. 1. The coin travels along a path 220 in the coin validator 200 past sensors 225, 227.

The sensors 225, 227 generate electrical signals which are provided to a coin mechanism controller 230 having control circuitry, including a microprocessor or micro-controller. The controller 230 is also connected to the vend controller 130 through the communication lines 140 shown in FIG. 1. The electrical signals generated by the sensors 225, 227 contain information corresponding to the measured characteristics of the coin, such as the coin's diameter, thickness, metal content and electromagnetic properties. Based on these electrical signals, the controller 230 is able to discriminate whether the coin is acceptable, and if so, the denomination of the coin 210.

If the coin 210 is unacceptable, the coin mechanism controller 230 controls a gate 235 to direct the unacceptable coin 210 to a reject chute 240. The reject chute 240 is connected to the coin return of FIG. 2. In contrast, if the coin 210 is acceptable, the coin mechanism controller 230 provides information concerning the denomination of the accepted coin to the vend controller 130 over communication lines 140 of FIG. 1.

Figure 3:
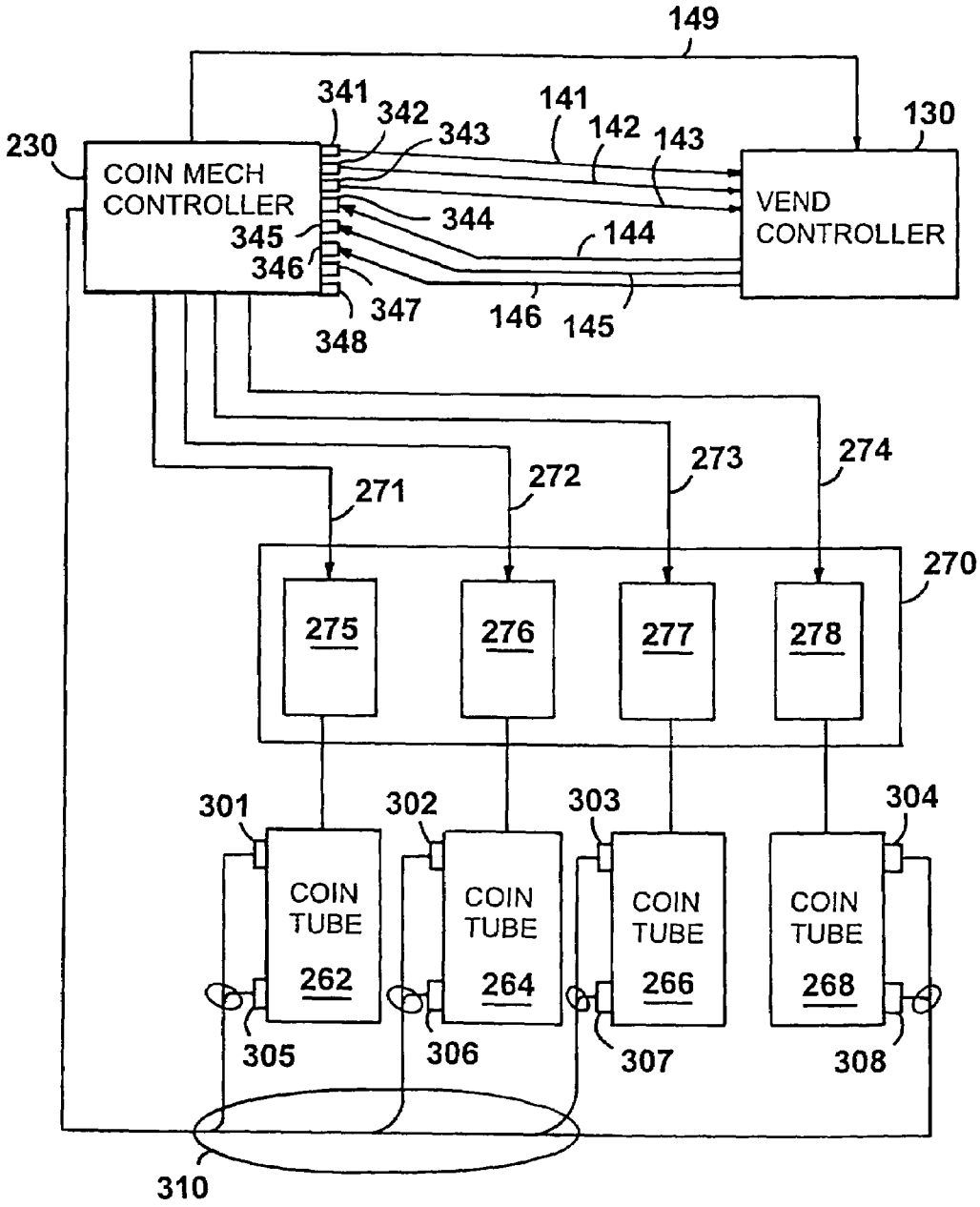
FIG. 3 is block diagram showing various connections between components of a machine according to the invention.

The vend controller 130 is programmed to process signals for a particular set of coin denominations, and the communication lines 140 between the vend controller 130 and the coin mechanism controller 230 include separate signal lines corresponding to each such coin denomination. Thus, for purposes of illustration only, it is assumed in the following discussion that the vend controller 130 is programmed to recognize and process signals corresponding to U.S. nickels, dimes and quarters only. In this implementation, as shown in FIG. 3, the communication lines 140 connecting the coin mechanism controller 230 and the vend controller 130 include three coin denomination receipt lines 141, 142 and 143 for sending signals corresponding, respectively, to the receipt of acceptable nickels, dimes and quarters. The communication lines 140 connecting the vend controller 130 and the coin mechanism controller 230 further include change dispense lines 144, 145 and 146 which are used as explained below. Each of the change dispense lines 144–146 corresponds to one of the coin denominations for which signals can be processed and generated by the vend controller 130. Thus, for example, the dispense lines 144, 145 and 146 are used to send signals corresponding to U.S. nickels, dimes and quarters, respectively. The coin mechanism controller 230 is designed to connect to the coin denomination receipt lines 141–143 and the dispense lines 144–146 via ports 341–346, respectively. The coin mechanism controller 230 can include other ports 347, 348 for connection to additional coin denomination receipt lines and/or dispense lines when the system 1 is configured with a vend controller programmed to handle a larger number of coin denominations. It should be noted that instead of the three coin denomination lines 141–143, a single serial communication line can be used. The coin mechanism controller 230 would then send a value over the serial communication line to indicate which denomination coin was received. Similarly, the three change dispense lines 144–146 can be replaced by a single serial communication line.

In general, the removable coin mechanism 110 may be capable of recognizing a set of U.S. coins different from the set of coins corresponding to the signals which the vend controller 130 is programmed to process. Thus, for example, in the following discussion, it is assumed that the coin mechanism 110 is capable of recognizing and discriminating between U.S. nickels, dimes, quarters and one-dollar coins. When the validator 200 determines that an inserted coin 210 is an acceptable nickel, dime or quarter, the coin mechanism controller 230 sends a signal along the corresponding one of the lines 141, 142 or 143. Each such signal sent from the coin mechanism controller 230 to the vend controller 130 can take the form, for example, of a single pulse. If, on the other hand, the validator 200 determines that the inserted coin is an acceptable one-dollar coin, then the controller 230 sends, for example, four pulses along the line 143. From the perspective of the vend controller 130, the receipt of a valid one-dollar coin in the coin mechanism is interpreted as the receipt of four quarters. Of course, the coin mechanism controller 230 can be programmed to report that some other combination of lower denomination coins, such as ten dimes, or five dimes and ten nickels, was received. In any event, the vend controller 130 processes the signals received from the coin mechanism controller 230 to keep track of the total credit available to the customer. In certain implementations, the vend controller 130 controls the display 95 so that the total available credit is displayed to the customer.

Returning to FIG. 2, acceptable coins 210 are directed to the coin separator 205 by the gate 235. The coin separator has multiple gates 245, 247, 249 and 251, also controlled by signals from the controller 230, for diverting the coin 210 from a main path 250. For better clarity, the connections between the controller 230 and the gates 245–251 are not shown in FIG. 2. The coin 210 can be diverted into respective paths 252, 254, 256 and 258, or the coin 210 can be allowed to proceed along the path main 250 to a path 260 leading to the cash box 120.

Each of the paths 252, 254, 256 and 258 leads to a respective one of four coin tubes or containers 262, 264, 266 and 268. Each coin tube 262–268 is arranged to store a vertical stack of coins of a particular denomination which can be recognized and accepted by the coin mechanism 110. Thus, for example, in one implementation, the coin tubes 262, 264, 266 and 268 store U.S. nickels, dimes, quarters and one-dollar coins, respectively. Although four coin tubes are shown in FIG. 2, any number can be provided.

A dispenser 270 associated with the coin tubes 262–268 is operable to dispense coins from the tubes when change is to be given by the coin mechanism 110. As shown in FIG.

3, the dispenser 270 can include either multiple solenoids or motors 275, 276, 277 and 278 each of which is associated with a respective one of the coin tubes 262–268 and controls the dispensing of coins from the respective tube. Suitable dispensers include those described in U.S. Pat. Nos. 3,814,115 and 4,367,760, assigned to the assignee of the present invention, which are incorporated by reference herein. Each solenoid or motor 275–278 in the dispenser 270 is connected to the coin mechanism controller 230 by respective dispense lines 271, 272, 273 and 274. The coin mechanism controller 230 controls the dispensing of coins from the tubes 262–268 by sending dispense signals, such as pulses, along the dispense lines 271–274 to actuate the solenoids or motors. Dispensed coins are sent to the coin return 80 where they can be retrieved by the customer.

One or more coin level sensors 301–308 are associated with each of the coin tubes 262–268. For example, in the implementation shown in FIG. 3, each coin tube 262–268 has a pair of coin level sensors. The sensors 301–308 provide signals to the coin mechanism controller 230 via communications lines 310. One sensor from each of the sensor pairs is used to determine when the coin tubes is full so that further coins of a particular denomination are directed to the cash box 120. The other sensor from each pair of sensors is used to determine when the coin tubes are empty, or near empty. Other coin level sensor arrangements and techniques can be used such as those described in U.S. Pat. No. 4,491,140, assigned to the assignee of the present invention, and incorporated by reference herein.

The vend controller 130 keeps track of whether accepted coins are routed to the coin tubes 262–268 or to the cash box 120. For this purpose, an additional signal line 149 connects the coin mechanism controller 230 to the vend controller 130. This signal line 149 is used to transmit signals to the vend controller 130 to report whether an acceptable coin is being routed to one of the coin tubes 262–268 or to the cash box 120. The vend controller 130 can also be pre-programmed with the number of coins which can be stored in coin tubes of particular denominations, and can keep track of the number of coins of each denomination that are reported to it as having been routed to the tubes 262–268.

In general, information reported to the vend controller 130 regarding the denomination, number and storage location of coins accepted by the coin mechanism 110 is controlled by the coin mechanism controller 230 by taking into account the distribution and denominations of coins in the coin tubes. Since one advantage of the coin mechanism 110 is that it can be used to update existing machines with an older versions of vend controllers, the coin mechanism controller 230 is programmed to modify the information reported to the vend controller 130 under specified circumstances. Thus, for example, as previously noted, when the coin mechanism 110 accepts a one-dollar coin, it reports to the vend controller 130, for example, that four quarters have been received. This allows the vend controller 130 to keep track of the total credit available to the customer, even though the vend controller 130 cannot directly process signals corresponding to the denomination of the accepted coin, in this case, a one-dollar coin.

In addition, it is occasionally desirable to route an accepted coin to an appropriate one of the coin tubes 262–268, but to report to the vend controller that the accepted coin is being stored in the cash box 120. For example, a particular vend controller, such as the vend controller 130, may be pre-programmed to accept five dollar bills only when a 25-cent coin tube is full so that sufficient coins will be available for dispensing change. The particular vend controller also may be pre-programmed to assume that the 25-cent tube is full when it receives information indicating that a quarter has been accepted and routed to the cash box 120. On the other hand, the desired amount of change required as a pre-condition for accepting a five dollar bill actually may be available even if the 25-cent tube is not full. Such a situation can arise, for example, due to the availability of one-dollar coins stored in the tubes 262–268. Thus, in an appropriate situation, the coin mechanism 110 can receive, accept and route an inserted quarter to one of the coin tubes 262–268, but report to the vend controller 130 that a single quarter was received and routed to the cash box 120. The vend controller 130 will then assume that the 25-cent coin tube is full and will allow the bill validator 100 to accept five dollar bills. Similarly, in appropriate situations, the coin mechanism controller 230 can route an accepted coin to the cash box 120, but report to the vend controller that the accepted coin is being stored in one of the coin tubes 262–268. The vend controller 130 can take certain actions in response to a signal indicating that the coin was routed to one of the coin tubes. For example, the bill validator 100 can be controlled so as to reject bills of a specified denomination. Specifically, as the amount of change remaining in the tubes 262–268 decreases, the bill validator 100 can be controlled to accept a one-dollar bill while rejecting five, ten and twenty dollar bills.

The coin mechanism controller 230 can also be programmed to report the total number of coins stored in each coin tube 262–268 after the receipt of a specified number of coins have been received or after a specified number of coins of a particular denomination have been received. Again, the coin mechanism controller 230 can be programmed to report to the vend controller 130 that a greater or lesser number of coins have been accepted than the number of coins that actually have been accepted. Such intentionally false reporting by the coin mechanism 230 may be desirable in situations similar to those discussed above with respect to the intentionally false reporting of the routing of the coins.

Figure 4:
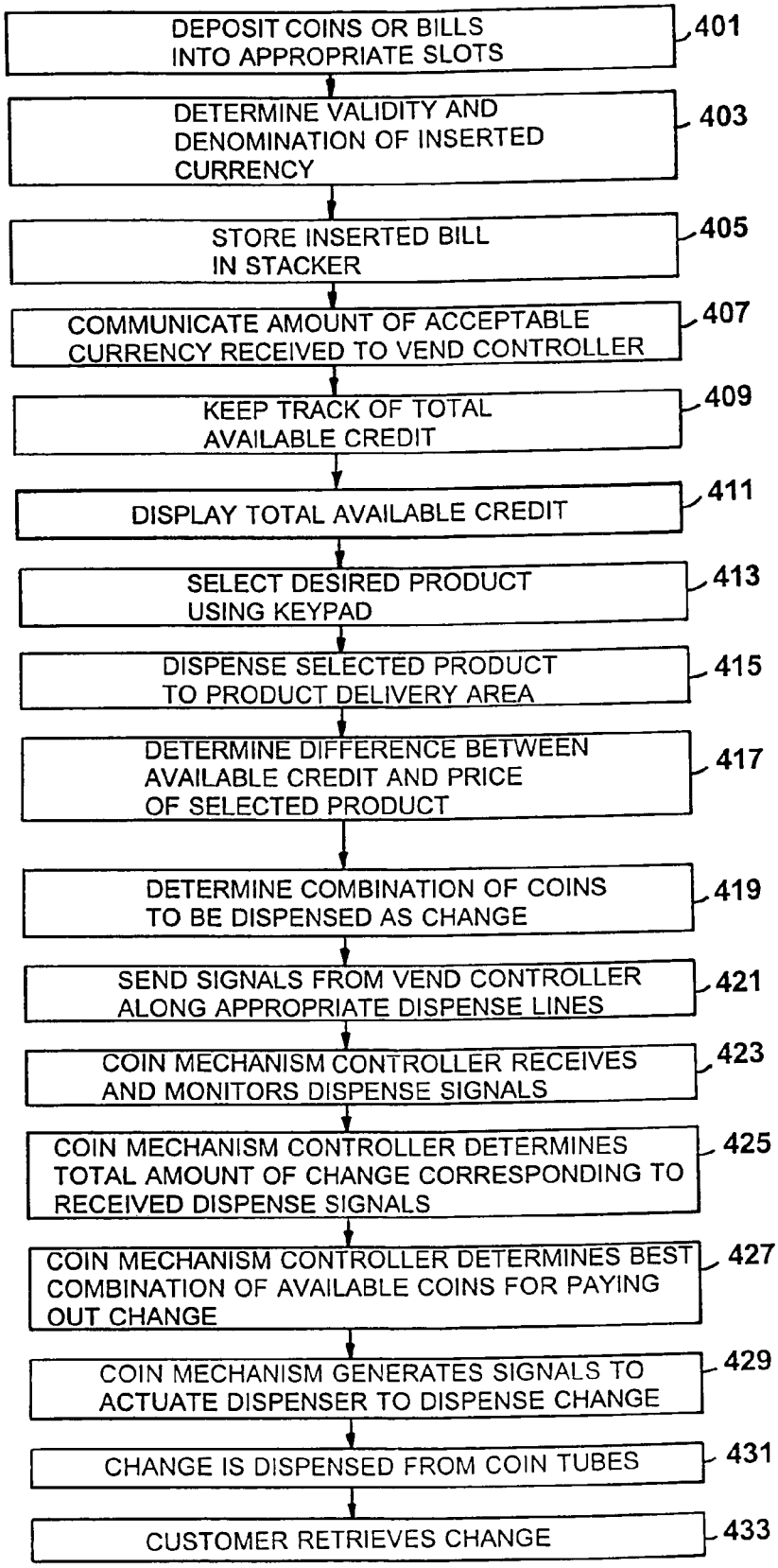
FIG. 4 is a flow chart showing the steps according to one implementation of the invention.

FIG. 4 is a flow chart showing the steps according to one implementation of the invention. In general, as indicated by 401, a customer can initiate a transaction by depositing coins or bills in the slots 50 or 60, respectively. For example, a particular customer might deposit a five dollar bill into the slot 60. If the bill validator 100 recognizes the inserted bill as genuine, it determines the denomination of the bill, as indicated by 403. The bill is then stored in the stacker 105, and the bill validator 100 sends a signal along the communication lines 140 to the vend controller 130 indicating the amount of acceptable currency received, as indicated by 405 and 407, respectively. As further indicated by 409, the vend controller 130 keeps track of the total credit available to the customer, which in this case, is five dollars. As indicated above, the total available credit can be displayed on the display 95, as shown in 411. Once sufficient payment has been deposited in the vending machine 1, the customer can select a product to be dispensed using the keypad 90, as shown in 413. As further indicated by 415, the selected product is then dispensed to a product delivery area (not shown) where it can be retrieved by the customer.

As indicated by 417, when the available credit exceeds the price of the selected product, the difference between the available credit and the price is determined by the vend controller 130. Thus, if the price of the selected product were $3.50, then using the aforementioned example, the calculated difference would be $1.50. Next, as shown by 419, the vend controller 130 determines a combination of coins for paying out the change to the customer. One known technique, for example, referred to as the "least number of coins" method, involves using as many higher-denomination coins as possible, so that the total number of coins is minimized. Any number of other techniques, however, can be employed to determine a combination of coins for dispensing the change, including the technique disclosed in U.S. Pat. No. 5,542,519, assigned to the assignee of the present invention and incorporated by reference herein. In the implementation discussed above, the vend controller 130 processes and generates signals corresponding to nickels, dimes and quarters only. Thus, according to the least number of coins method, the vend controller 130 would determine that the best form of paying out change of $1.50 is in the form of six quarters. As indicated by 421, the vend controller 130 would send six signals, each of which can take the form of a single pulse, along the dispense line 146. The coin mechanism controller 230 receives and monitors these pulses, as indicated by 423.

Since, in general, the coin mechanism 110 may be capable of paying out change using a set of coins different from the set of coins which the vend controller 130 is programmed to handle, the best combination of coins for paying out the change as determined by the vend controller 130 may not, in fact, be the best form of paying out the change available from the coin tubes 262–268. Therefore, as shown by 425, the controller 230 recognizes each signal or pulse received on the dispense lines 144–146 as corresponding to a predetermined value and determines a total amount of change, in this case $1.50, corresponding to the monitored signals. As indicated by 427, the controller 230 then determines the best combination of available U.S. nickels, dimes, quarters and one-dollar coins for paying out the change to the customer. For this purpose, the controller 230 can be programmed to use the same technique as the vend controller 130 for determining the best form for paying out the change. Alternatively, the controller 230 can use a different technique. Using the "least number of coins method" and, assuming, for example, that nickels, dimes, quarters and one-dollar coins are available for paying out change from the tubes 262–268, the controller 230 would determine that the change of $1.50 should be paid out in the form of a single one-dollar coin and two quarters. As further indicated by 429, the coin mechanism controller 230 generates signals to actuate the dispenser 270 to dispense the proper change from the coin tubes 262–268. For example, the controller 230 would generate a single pulse which is transmitted along the dispense line 274 and two pulses which are transmitted along the dispense line 273. These pulses actuate the solenoids or motors 278 and 277, respectively, thereby causing a single one-dollar coin and two quarters to be dispensed from the coin tubes 268 and 266, respectively, as indicated by 431. The dispensed coins can then be retrieved by the customer, as indicated by 433.

In general, the coin mechanism controller 230 monitors the signals transmitted from the vend controller 130 on the dispense lines 144–146 and acts as an interface between the vend controller 130 and the dispenser 270. Specifically, the coin mechanism controller 230 re-determines the best combination of coins in which to dispense the change owed to a customer by taking into account the distribution and denominations of coins in the coin tubes 262–268. Thus, with reference to the example discussed above, the controller 230 causes the coin mechanism to dispense a single one-dollar coin and two quarters, rather than six quarters as indicated by the signals on the dispense lines 144–146.

In different implementations, the coin mechanism controller 230 can be programmed to use various techniques to monitor the signals on the dispense lines 144–146 and to begin paying out the change. According to a first technique, the coin mechanism 110 accumulates the values corresponding to the monitored signals on the dispense lines 144–146 until no additional pulse is received during a specified duration T following the previous pulse. The specified duration can be, for example, on the order of milliseconds. Payout does not take place until no further pulses are received for the specified duration T. According to a second technique, the values corresponding to the monitored signals are accumulated, and payout of a single coin of the highest denomination occurs once the total accumulated value is at least equal to or higher than the value of the highest available coin denomination in the tubes 262–268. Any total accumulated value greater than the value of the highest denomination coin is accumulated together with the value of the subsequently monitored pulses. Payout of the additional change occurs in the same manner, and a final payout occurs, if necessary, when no further pulses are received for the specified duration T. According to yet a third technique, the values corresponding to the monitored signals are accumulated for a predetermined number of pulses N, and payout corresponding to the accumulated value occurs immediately following receipt of the predetermined number of pulses. Payout of additional change occurs in the same manner, and a final payout occurs, if necessary, when no further pulses are received for the specified duration T.

Figure 5A:
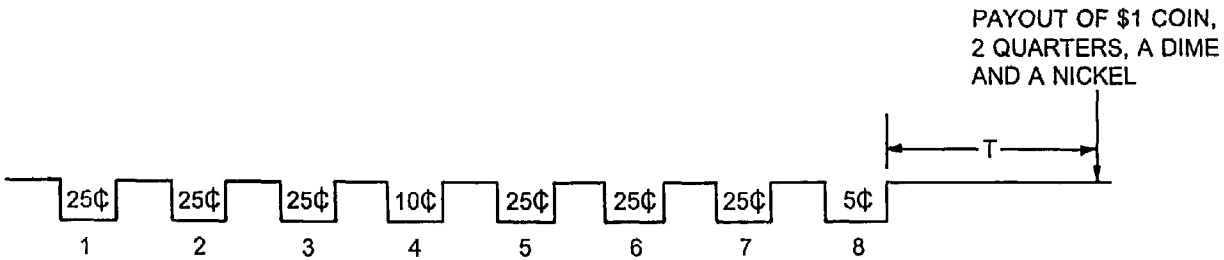
FIGS. 5A through 5C are timing diagrams for the payout of change according to the invention.
Figure 5B:
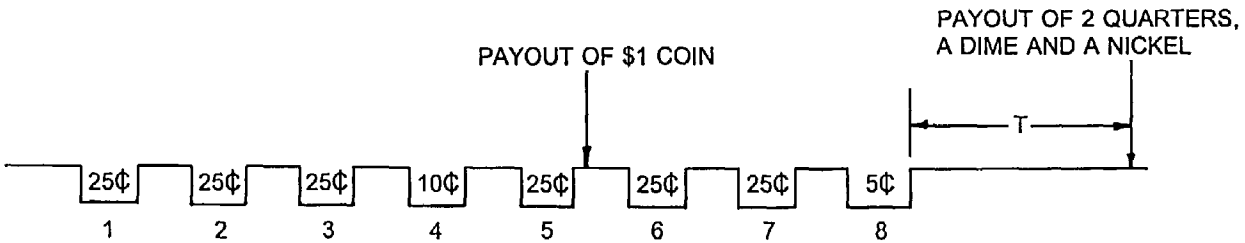
Figure 5C:
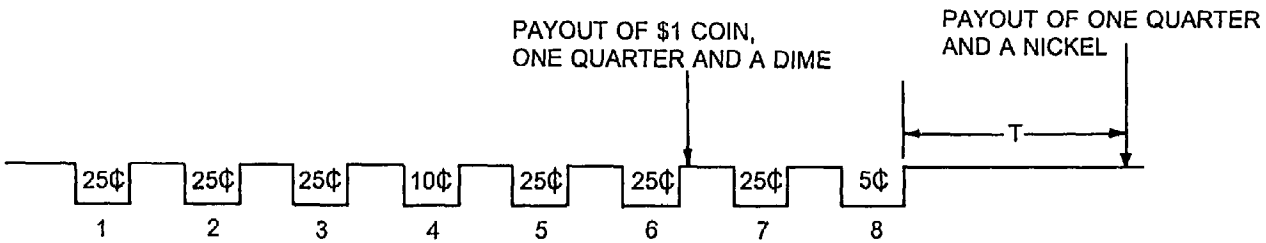

The aforementioned payout techniques are illustrated in FIGS. 5A–5C. For purposes of illustration only, it is assumed that the vend controller 130 determines that a customer is owed change totaling $1.65, and, accordingly, the vend controller 130 generates six pulses on the dispense line 146 and one pulse on each of the dispense lines 144 and 145, corresponding respectively, to six quarters, one nickel and one dime. The pulse train received by the coin mechanism controller 230 is illustrated in FIGS. 5A and 5B, where, for purposes of illustration only, pulses 1 through 3 and pulses 5 through 7 correspond to quarters, pulse 4 corresponds to a dime, and pulse 8 corresponds to a nickel. It is further assumed that the time lag between respective pulses is less than the specified period T, so that the end of the pulse train is recognized by the controller 230 as occurring a period T after receipt of pulse 8. In addition, it is assumed for the purposes of illustration only, that all the coin tubes 262–268 are full. With respect to the third technique, illustrated in FIG. 5C, it is assumed that the predetermined number of pulses N after which payout occurs is six. In general, the number of pulses N is variable depending on the number coin tubes and the different denominations associated with the coin tubes. Using this example, all three techniques result in the payout of a single one-dollar coin, two quarters, a dime and a nickel. The time when payout occurs, however, differs.

According to the first technique, illustrated in FIG. 5A, there is no payout until a time period T following receipt of pulse 8. According to the second technique, illustrated in FIG. 5B, payout of a single one-dollar coin occurs immediately after receipt of pulse 5, and payout of two quarters, a dime and a nickel occurs after the period T following receipt of pulse 8. According to the third technique, illustrated in FIG. 5C, payout of a single one-dollar coin, a quarter and a dime occurs after receipt of pulse 6, and payout of another quarter and a nickel occurs after the period T following receipt of pulse 8.

As indicated above, the coin mechanism controller 230 is programmed to take account of the distribution and denominations of coins in the coin tubes 262–268. Thus, for example, if the one-dollar coin tube 268 is empty, there is no need for the controller 230 to re-calculate the best form of paying out the change, because the coin types currently available as change from the coin mechanism 110 correspond to the coin types for which the vend controller 130 generates signals on the dispense lines 144–146. Using the example discussed above with respect to FIGS. 5A–5C, the controller 230 would generate six pulses which are transmitted along the dispense line 273, one pulse which is transmitted on the dispense line 272, and one pulse which is transmitted along the dispense line 271. The dispenser 270 would then dispense six quarters, one dime and one nickel.

Figure 6:
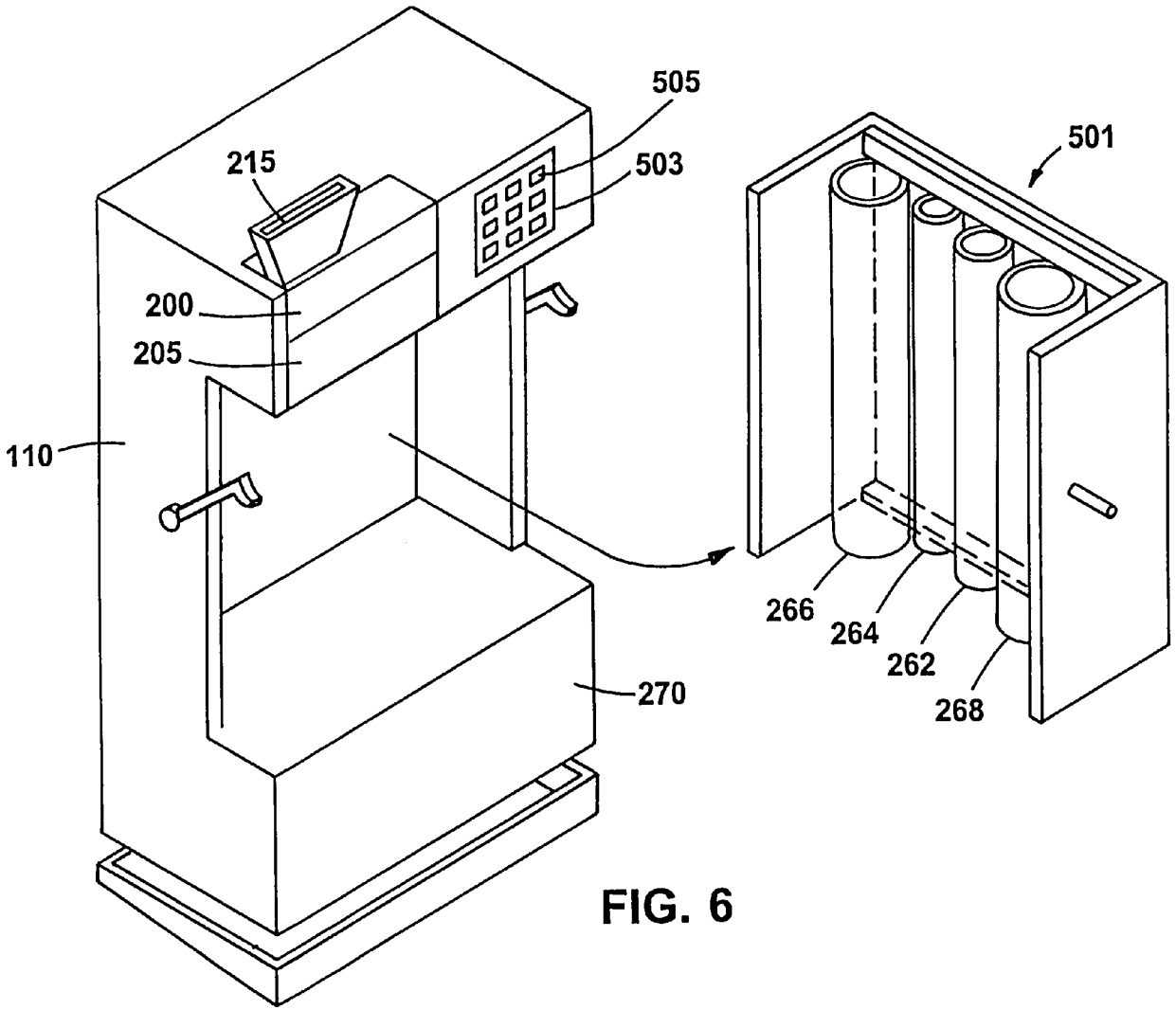
FIG. 6 is a block diagram of a coin mechanism showing further features of the invention.

In a further aspect of the invention illustrated in FIG. 6, the coin tubes 262–268 can be part of a removable and replaceable cassette 501. One such suitable cassette is described in U.S. Pat. No. 5,400,891, assigned to the assignee of the present invention, and incorporated by reference herein. The feature of a removable and replaceable cassette permits various cassettes, each of which can differ according to the distribution of denominations associated with the coin tubes 262–268, to be used in conjunction with the coin mechanism 110 and the vending machine 1. As before, the coin mechanism controller 230 serves as an interface between the vend controller 130 and the coin mechanism 110. To identify the arrangement of the coin tubes in a particular cassette to the coin mechanism controller 230, the coin mechanism 110 includes a keypad 503 with multiple buttons 505, which are electrically connected to the coin mechanism controller 230. The keypad 503 can be used, among other things, to enter a code, such as a four-letter or four-digit code, that identifies the arrangement of the coin tubes to the coin mechanism controller 230. The code may also be a combination or a particular sequence of letters and numbers that can be suitably entered using the keypad 503. The coin mechanism controller 230 is programmed to recognize the code, and, in response to the code, to operate and control the gates 245–251 in FIG. 2 to divert an accepted coin to a proper one of the tubes 262–268 or to the cash box 120. Once the coin mechanism controller 230 is provided with the information concerning the identity of the coin tube arrangement, the controller 230 can re-calculate the best combination of coins in which to dispense the change owed to a customer by taking into account the denominations as well as the distribution of coins in the coin tubes of the particular cassette.

Figure 7:
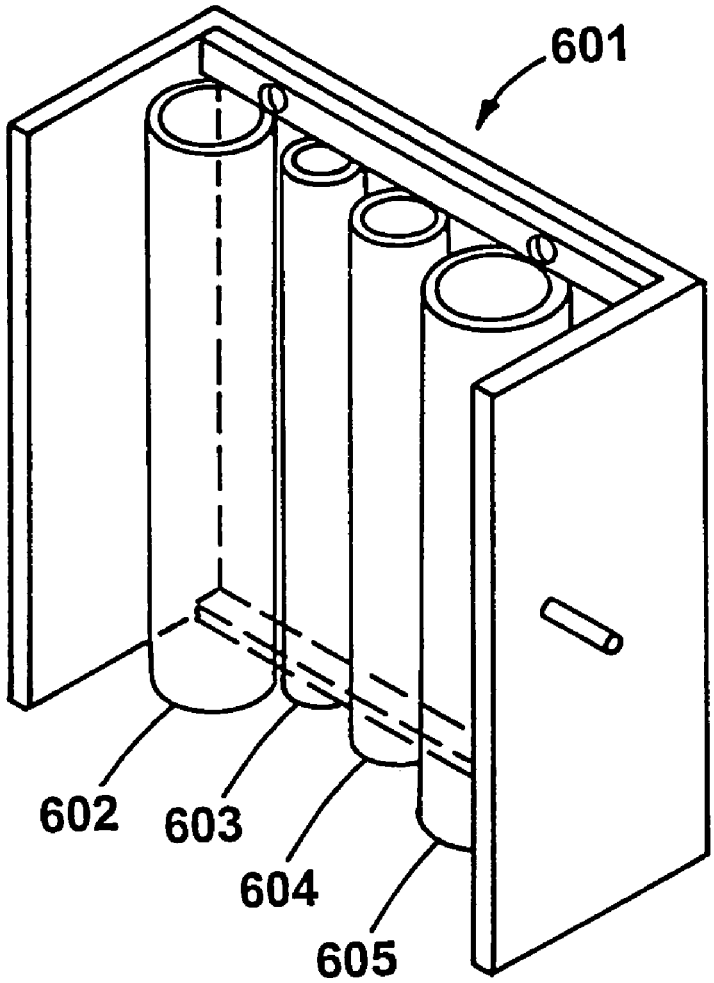
FIG. 7 illustrates an additional cassette with coin tubes which can be used with the coin mechanism of FIG. 6.

FIG. 7 shows a cassette 601 which includes four coin tubes 602–605, and which can replace the cassette 501 in FIG. 6. For the purposes of illustration, it is assumed that the coin tubes 602, 605 are arranged to store vertical stacks of nickels and the coin tubes 603, 604 are arranged to store stacks of dimes. Of course, other cassettes having different tube arrangements can also be used with the invention. For example, a cassette having four tubes each of which stores coins of the same denomination can be used. Alternatively, two tubes can store coins of a first denomination, while the remaining two tubes store coins of second and third denominations, respectively. In any event, when the cassette 601 is inserted into the coin mechanism 110 by service personnel, the service personnel enters a predetermined code using the keypad 503. The code corresponds to the particular arrangement of coin tubes in the cassette 601. The coin mechanism controller 230 receives and recognizes the code.

Again, for purposes of illustration, it is assumed that the vend controller 130 determines that a customer is owed change totaling $0.50 and generates two pulses on the dispense line 146 corresponding to two quarters. It is also assumed that the coin mechanism controller 230 is programmed to monitor the signals on the dispense lines 144–146 according to the second technique in which the values corresponding to the monitored signals are accumulated, and payout of a single coin of the highest available denomination occurs once the total accumulated value is at least equal to or higher than the value of the highest available coin in the tubes 602–605. Any total accumulated value greater than the value of the highest denomination coin is accumulated together with the value of the subsequently monitored pulses. Payout of the additional change occurs in the same manner, and a final payout occurs, if necessary, once no further pulses are received for the specified duration T. In this example, two dimes would be dispensed immediately after receipt of the first pulse on the dispense line 146, and three dimes would be paid out immediately after receipt of the second pulse on the dispense line 146.

In various implementations, the invention provides one or more of the following advantages. Since the coin mechanism controller 230 serves as an interface between the vend controller 130 of the vending machine 1 and other components in the coin mechanism 110, the coin mechanism 110 can be used to update existing vending machines without replacing the vend controller. For example, an existing vending machine 110 can be upgraded to accommodate new or different combinations of coin sets by replacing an existing coin mechanism with the coin mechanism of the invention. In particular, an existing vending machine can be upgraded relatively easily to accept payment and dispense change in the form of new or different combinations of coin denominations. For example, by using the coin mechanism of the invention, a vending machine can be updated to dispense a one-dollar coin even though the existing vend controller generates signals indicating that four quarters should be dispensed. The coin mechanism 110 is sufficiently flexible and adaptable that it also can be used with vending machines whose vend controller has already been updated to accommodate new or different combinations of coin denominations. Furthermore, removable and replaceable cassettes with different arrangements of coin tubes can be used with a single coin mechanism. The use of a keypad allows service personnel to enter a code which is transmitted to the coin mechanism controller and provides a convenient means for identifying the coin tube arrangement in the cassette to the coin mechanism controller. The coin mechanism of the invention can, therefore, provide enhanced flexibility and adaptability to existing machines with relative ease and at relatively low cost.

Although the invention has been described with respect to vending machines, the coin mechanism of the invention can be used in any apparatus, such as a gaming machine which accepts payment and/or dispenses change in the form of coins. The invention can also be used in connection with semi-automatic transaction systems, such as cash registers. Similarly, although the invention has been described with respect to machines that dispense coins as change, the invention can also be used in a machine which dispenses coins as a prize to the customer.

Other implementations are contemplated within the scope of the following claims.

What is claimed is:

1. A coin mechanism comprising:

at least one coin tube, each of which stores coins of a respective denomination;

a dispenser for controlling the dispensing of coins from the at least one coin tube; and a coin mechanism controller suitable for connection to a controller in an automatic transaction system so as to receive change dispense signals from the automatic transaction system controller indicating the form of dispensing change to a customer, wherein the coin mechanism controller, when connected to the automatic transaction system controller, serves as an interface between the automatic transaction system controller and the dispenser, wherein the coin mechanism controller is programmed to monitor the change dispense signals from the automatic transaction system controller, to accumulate values corresponding to the monitored signals, to re-determine coin denominations in which the change is to be dispensed by taking into account the distribution and denominations of coins in the at least one coin tube, and to control the dispenser to dispense change from the at least one coin tube only after no further change dispense signal is received for at least a specified duration following the previous change dispense signal.

2. The coin mechanism of claim 1 wherein the coin mechanism controller is programmed to re-determine the number and denomination of coins in which the change is to be dispensed when the set of available coin denominations in the at least one coin tube differs from the set of coin denominations which the automatic transaction system controller is programmed to handle.

3. The coin mechanism of claim 1 wherein the coin mechanism controller is programmed to re-determine the number and denomination of coins in which the change is to be dispensed when the set of available coin denominations in the at least one coin tube differs from the coin denominations corresponding to the change dispense signals received from the automatic transaction system.

4. A coin mechanism according to claim 1 suitable for connection to an automatic transaction system controller capable of providing signals indicating the number and denomination of coins in which change is to be dispensed using three different coin denominations, wherein the coin mechanism comprises four coin tubes for storing, respectively, coins of four different denominations.

5. A coin mechanism according to claim 1 suitable for connection to an automatic transaction system controller capable of providing signals indicating the number and denomination of coins in which change is to be dispensed using three different coin denominations, wherein the coin mechanism comprises two coin tubes for storing coins of a first denomination and two coin tubes for storing coins of a second denomination.

6. A coin mechanism according to claim 1 suitable for connection to an automatic transaction system controller capable of providing signals indicating the number and denomination of coins in which change is to be dispensed using three different coin denominations, wherein the coin mechanism comprises four coin tubes each of which is for storing coins of a single, respective, denomination.

7. The coin mechanism of claim 6 wherein the three coin denominations are U.S. nickels, dimes and quarters, and wherein the four coin denominations are U.S. nickels, dimes, quarters and one-dollar coins.

8. The coin mechanism of claim 1 wherein the coin mechanism controller is programmed to re-determine the number and denomination of coins in which the change is to be dispensed using as many available higher denomination coins as possible.

9. A method of providing change from an automatic transaction system comprising:

generating change dispense signals corresponding to the number and denomination of coins in which the change is to be dispensed;

receiving the change dispense signals in a coin mechanism controller;

monitoring the coin dispense signals received in the coin mechanism controller;

accumulating values corresponding to the monitored signals;

re-determining the number and denomination of coins in which the change is to be dispensed by taking into account the distribution and denominations of coins in coin tubes associated with the coin mechanism;

generating new change dispense signals based on the step of re-determining to control the dispenser to dispense change from the coin tubes only after no further coin dispense signal is received by the coin mechanism controller for at least a specified duration following the previously received change dispense signal.

10. The method of claim 9 wherein re-determining occurs when the set of available coin denominations in the coin tubes differs from the set of coin denominations corresponding to the signals received by the coin mechanism controller.

11. The method of claim 9 wherein re-determining comprises re-determining the number and denomination of coins in which the change is to be dispensed using as many available higher denomination coins as possible.

12. The method of claim 9 wherein generating change dispense signals includes generating signals corresponding to four quarters, and wherein dispensing includes dispensing a single one-dollar coin.

* * * * *